US007828240B2

(12) United States Patent
Hagleitner

(10) Patent No.: US 7,828,240 B2
(45) Date of Patent: Nov. 9, 2010

(54) BEARING JOURNAL FOR SUPPORTING A MATERIAL WEB

(76) Inventor: Hans Georg Hagleitner, Lindenallee 11, Zell am See (AT) A-5700

( * ) Notice: Subject to any disclaimer, the term of this patent is extended or adjusted under 35 U.S.C. 154(b) by 177 days.

(21) Appl. No.: 11/801,321

(22) Filed: May 9, 2007

(65) Prior Publication Data

US 2008/0121750 A1 May 29, 2008

(30) Foreign Application Priority Data

Nov. 28, 2006 (EP) ..... 06024601

(51) Int. Cl.
*B65H 16/06* (2006.01)

(52) U.S. Cl. ..... 242/598.3; 242/599.2; 242/599.3; 242/599.4

(58) Field of Classification Search ..... 242/599.3, 242/599.4, 599, 596, 596.7, 598, 598.3, 599.2, 242/590, 570; 384/295, 428, 438, 439, 418, 384/419; 225/47, 46, 39, 77; 83/649, 650
See application file for complete search history.

(56) References Cited

U.S. PATENT DOCUMENTS

| | | | | |
|---|---|---|---|---|
| 1,990,806 | A * | 2/1935 | Watson et al. | 193/37 |
| 3,373,529 | A | 3/1968 | Ingham | |
| 3,602,450 | A | 8/1971 | Jespersen | |
| 4,340,195 | A * | 7/1982 | DeLuca | 242/560 |
| 5,249,755 | A * | 10/1993 | Jespersen | 242/596.7 |
| 5,630,563 | A * | 5/1997 | Meisner et al. | 242/598.6 |
| 5,676,331 | A | 10/1997 | Weber | |
| 5,988,561 | A * | 11/1999 | Mele | 242/599.1 |
| 6,082,664 | A * | 7/2000 | Phelps et al. | 242/596.5 |
| 6,533,153 | B2 * | 3/2003 | Huang | 225/47 |
| 6,581,295 | B1 | 6/2003 | Black | |
| 6,814,684 | B2 * | 11/2004 | Schulz et al. | 475/331 |
| 2003/0071052 | A1 | 4/2003 | Castleberry | |
| 2008/0229791 | A1 | 9/2008 | Granger et al. | |

FOREIGN PATENT DOCUMENTS

| | | | |
|---|---|---|---|
| EP | 0 657 134 | B1 | 11/1997 |
| FR | 2879092 | A1 | 6/2006 |
| GB | 2289039 | A | 11/1995 |
| WO | 1996023719 | A1 | 8/1996 |
| WO | WO 96/23719 | | 8/1996 |
| WO | 99/26521 | | 6/1999 |
| WO | 2005094653 | A1 | 10/2005 |

OTHER PUBLICATIONS

Eurasian Search Report dated Sep. 8, 2007.
Alexander Philipowitsch Krainev, Verlag Maschinostrojenie, Moskau, Encyclopedia "Mechanik," pp. 202-203, Dec. 9, 1996.

* cited by examiner

*Primary Examiner*—John Q Nguyen
*Assistant Examiner*—Juan J Campos
(74) *Attorney, Agent, or Firm*—Laurence A. Greenberg; Werner H. Stemer; Ralph E. Locher

(57) ABSTRACT

A bearing journal projects from an end of a material web wound into a roll. The bearing journal has a bearing surface formed as a rotating surface, a fitting surface not formed as a rotating surface, and an axial guide surface. A dispensing system includes a dispenser that is adapted to receive the roll of web material and to cooperate with the bearing journal.

3 Claims, 3 Drawing Sheets

BEARING JOURNAL FOR SUPPORTING A MATERIAL WEB

CROSS-REFERENCE TO RELATED APPLICATION

This application claims the priority, under 35 U.S.C. §119, of European application EP 06024601.4, filed Nov. 28, 2006; the prior application is herewith incorporated by reference in its entirety.

BACKGROUND OF THE INVENTION

Field of the Invention

The invention relates to a bearing journal for attachment, projecting at the end, to a material web wound into a roll, with a bearing surface formed as a rotating surface, and with a fitting surface not formed as a rotating surface, as well as a dispenser for sections to be cut off from a material web wound into a roll, at both ends of which a bearing journal projects in each case, wherein for each bearing journal the dispenser has a guide ending in a dispensing position, and a constriction is provided at the start of at least one guide.

The expression "surface not formed as a rotating surface" refers to a surface, the generatrix of which varies in distance from the axis of the bearing journal. Surfaces not formed as a rotating surface are thus, optionally also curved, side-surfaces of bars or grooves which are provided at the end on the bearing journals, stepped surfaces in a graduation of the end of the bearing journal, or a prismatic generated surface at the end-section of the bearing journal.

Such rolls comprise various material webs that are wound onto cores or core sleeves or also wound without a core, wherein end bearing journals are attached in order to be able to roll up the material web. This is the case in particular when the rolls are cut from a roll strand, as is generally the case with household paper, sanitary paper, toilet paper, etc. Various possibilities present themselves for the attachment of the bearing journals. For one, two end-pieces or end-caps from which the bearing journals project can be inserted. For another, the rolls can be provided with continuous support rods, wherein the support rods are longer than the rolls and the salient end-sections form the bearing journals. Housings or guides for such rolls, in particular on holders or dispensers, generally have grooves into which the bearing journals are inserted. In most cases the correct arrangement of the rolls must be ensured in order that the end of the material web always hangs down on the same side of the roll. For this purpose it is known (U.S. Pat. No. 3,602,450) to form the bearing journals and the associated guides on the two sides with different diameters and correspondingly different distances between the guide surfaces of the guides.

In particular with material webs of little value, such as for example household paper, toilet paper or other sanitary papers, the materials used for the bearing journals are also inexpensive rather than not, and thus only have sufficient stability or strength to preferably allow a repeated use. The bearing journals cannot however withstand damage which can be caused by forceful attempts to insert the roll into the holder or dispenser incorrectly despite the fact that the difference between the two sides makes it clear what belongs where.

In order to rule out the incorrect insertion of the rolls even applying a small amount of force, it has become known from European patent EP 657134 (U.S. Pat. No. 5,676,633) to make it more certain that bearing journals and guides are correctly allocated by forming in the introduction section of the dispenser a control element projecting at least into a guide and a corresponding recess on the associated bearing journal. For example the bearing journal can be provided at the end with a diametrical groove so that it can fit a corresponding bar in the guide.

Since the rolls must be easily movable in the guides, for example in order to drop under the effect of gravity from a storage position into a lower dispending position, a jamming of the bearing journals in the guides must be avoided as much as possible.

SUMMARY OF THE INVENTION

It is accordingly an object of the invention to provide a bearing journal for attachment, which overcomes the above-mentioned disadvantages of the heretofore-known devices and methods of this general type and which securely avoids a jamming of the bearing journals in the guides. While this can of course be achieved most easily by sufficient clearance between the cooperating parts, the clearance must not, of course, become so great that the rolls can be inverted once in place or the wrong rolls also inserted.

With the foregoing and other objects in view there is provided, in accordance with the invention, a bearing journal for supporting a material web, the bearing journal projecting from an end of a roll of the material web. The novel bearing journal comprises:

a bearing surface formed as a rotating surface;

a fitting surface not formed as a rotating surface; and an axial guide surface formed on the bearing journal.

Since a disproportionate clearance in particular in axial direction can lead to the above-noted problems, the bearing journal is provided according to the invention with an axial guide surface which can be guided along a counter-surface of the guide in the holder or dispenser.

In a preferred embodiment the bearing journal has a circumferential groove, and the axial guide surface is formed by the side-surface of the circumferential groove nearer the free end of the bearing journal. In other words, adjoining the circumferential groove is a flange-like section with a larger diameter, which can engage behind a guide surface formed on bars facing each other on the guide of the holder or dispenser. The bottom of the circumferential groove is in particular a circular cylindrical surface, but can also be a conical surface or similar.

As an alternative to the formation of a circumferential groove, several tooth-like projections or burls could for example also be provided distributed over the journal periphery, the sides of which suffice as an axial guide surface. A circumferential groove in the smaller of two bearing journals is described, by way of example, in international patent publication WO 96/23719. There, the circumferential groove serves to provide more than one criterion on at least one side in order to make incorrect insertion difficult. Thus for example two rotation surfaces separated from each other can also be provided on the bearing journal, which correspond with two bars or ribs on the bearing surfaces. It is also named as an additional advantage that bearing journals with two circumferential grooves can also be inserted in guides with a rib on the guide surfaces, so that a holder or dispenser can receive not just a specific roll. However, this advantage simultaneously constitutes a disadvantage, since the so-called coding, i.e. a specific determination of fitting surfaces and guide surfaces, can be circumvented if a criterion need not be met on one of the two cooperating parts and the bearing journals nevertheless fit in the guides without force.

In the case of a dispenser according to the invention it is provided that the guide has, at least in the area of the constriction, two guide surfaces at an angle to each other. Preferably the two guide surfaces are at a right angle to each other, wherein the first guide surface is provided on the constriction of the guide formed by a projection or similar. Since there are several possibilities for the design of the constriction, it is preferably further provided that the guide surfaces are located on an insert fitted into the first section of the guide. The dispensers can thus easily be adapted to different bearing journals.

A dispenser system consists of a dispenser of the type described and at least one material web wound into a roll, on both sides of which a bearing journal of the type described projects in each case. According to the invention it is provided that the constriction of the guide is formed with a counter-surface corresponding to the fitting surface of the bearing surface, which allows the insertion of the roll into the dispenser. In order to achieve this the roll or the bearing journal is to be turned to the extent that the two surfaces coincide.

Other features which are considered as characteristic for the invention are set forth in the appended claims.

Although the invention is illustrated and described herein as embodied in bearing journal for attachment, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
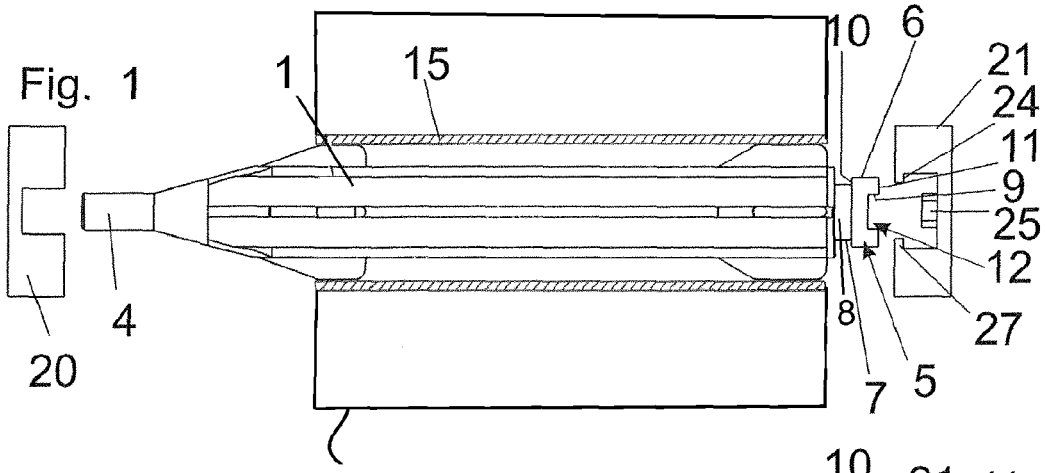
FIGS. 1 to 5 are side views each showing a support rod allocated to a guide with a simple bearing journal and with a bearing journal according to the invention, in each case in different embodiments, wherein the two guides are drawn, for reasons of clarity, distanced from the two bearing journals.

Referring now to the figures of the drawing in detail, material webs 15*a* which are wound into rolls, in particular household or sanitary paper, generally require, since they are cut from a strand, bearing journals 4, 5 projecting at the end when they are inserted into guides and are housed rotatable there. The bearing journals 4, 5 can be provided on the ends of a support rod 1 or on end caps 2, 3 defining a roll, which are inserted for example into a cardboard tube or core sleeve 15. FIGS. 1 to 5 show in each case on the left a simple bearing journal 4 with a circular cylindrical rotating surface, which fits into a groove of the guide 20. In principle however it is also possible to form the bearing journals 4 and the guides 20 also according to one of the possibilities below, described for the bearing journals 5 and guides 21 shown on the right in each case, as the embodiment according to FIG. 7 shows.

Figure 5:
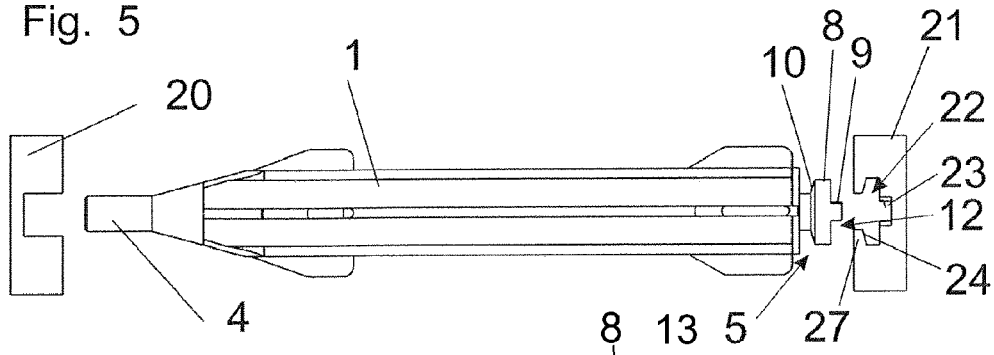
Figure 6:
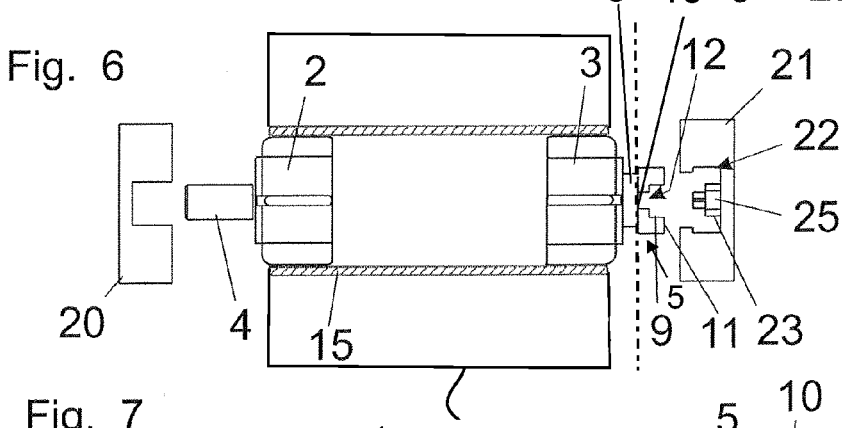
FIG. 6 is a side view of an embodiment with two bearing journals projecting from end caps.
Figure 7:
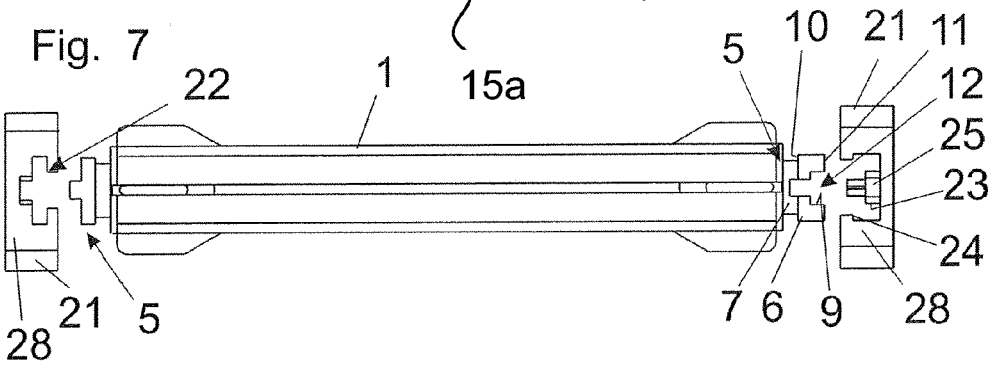
FIG. 7 is a side view showing a support rod with two bearing journals according to the invention.

Each bearing journal 5 also has a circular cylindrical rotating surface as bearing surface 8, which is formed according to FIGS. 1 to 4 by the bottom surface of a circumferential groove 7 and according to FIG. 5 and FIG. 7 on the left by the peripheral surface of the end-section 6 of the bearing journal 5.

Figure 8:
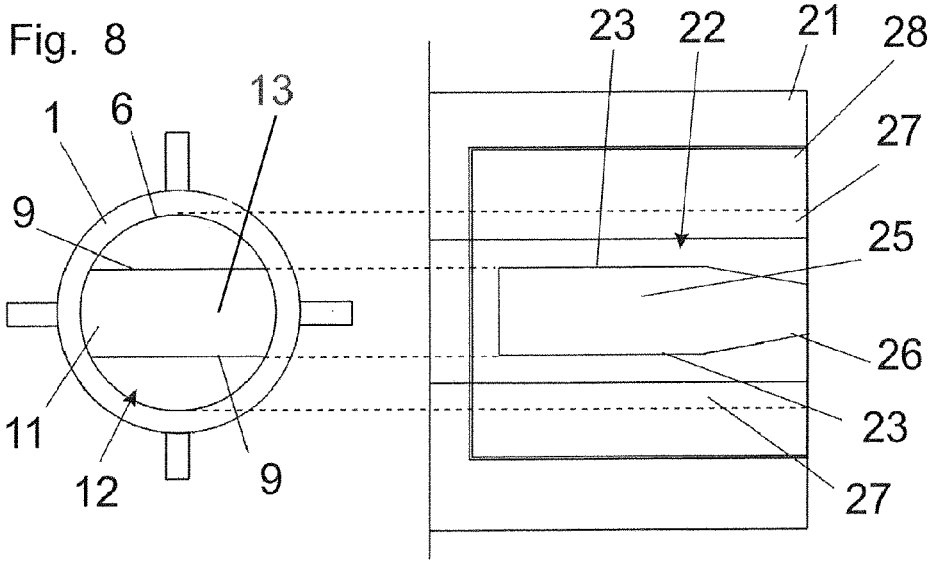
FIG. 8 is an enlarged top view of the guide and a corresponding end view of the bearing journal and the constriction of the embodiment according to FIG. 1.
Figure 9:
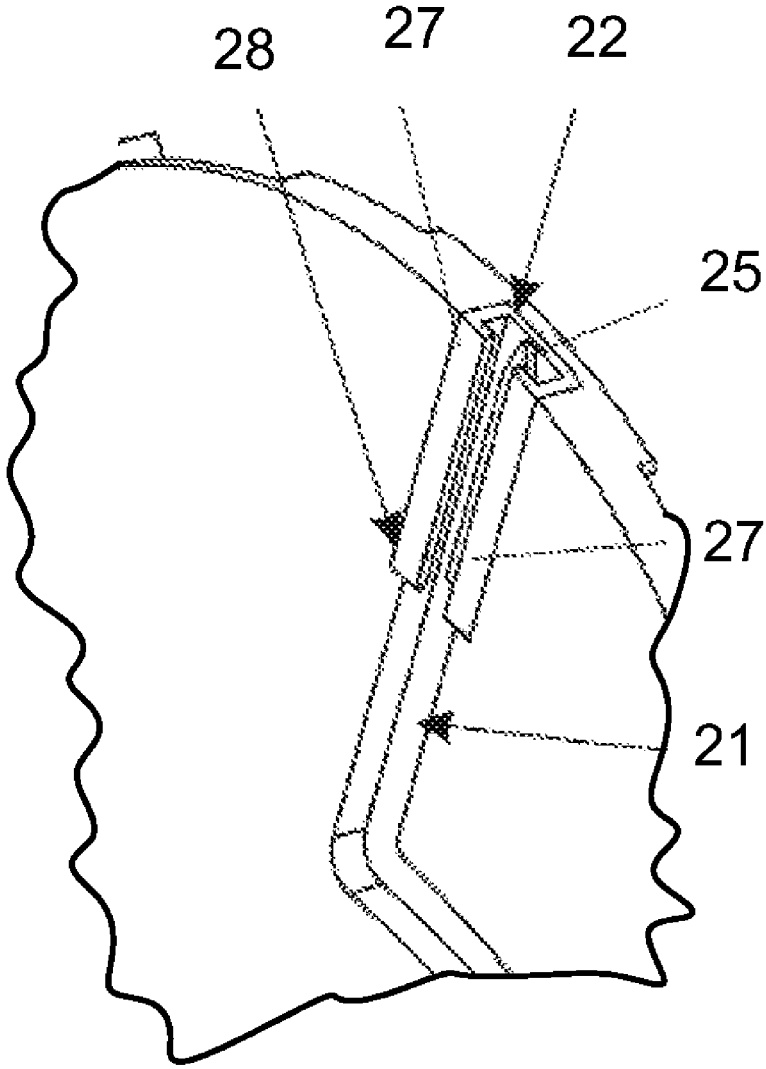
FIG. 9 is a partial perspective view of the guide.

In order to be able to insert only correctly aligned rolls in the different guides 20, 21, constrictions 22 are provided on the guides 21, through which only correspondingly formed areas of the bearing journals 5 can be passed. The constrictions 22 are formed by projections 25 or the like protruding into the guide 21, on which first guide surfaces 23 are provided which are preferably formed parallel to the axis of the roll and have increasing initial sections 26. The constrictions 22 are preferably provided on inserts 28 (FIGS. 7, 8), which can be introduced into the initial area of the guides 21.

On the free ends 11, the bearing journals 5 have recesses 12 which are formed diametrically opposed to the projections 25 in the guides 21. The recesses 12 are provided with fitting surfaces 9 which, unlike the bearing surfaces 8, are not rotating surfaces, but instead in particular flat side-surfaces of end grooves (FIGS. 1, 2, 4, 6, 7-right), of an end bar (FIGS. 5, 7-left), wherein the recesses 12 are formed by the areas on both sides of the bar, or by generated-surface sections 14 if the end-section 6 is prismatic (FIG. 3). As the figures show, the fitting surfaces 9 not formed as rotating surfaces and the first guide surfaces 23 on the projections 25 allow a large number of different combinations, should a coding between the bearing journals 5 and the guides 21 be desired not only so as to insert only correctly aligned rolls but also to prevent the use of the wrong rolls. In addition, as can be seen in FIGS. 1, 2, 3 and 6, the diameters of the bearing journals 5 in the area of the bearing surfaces 8 can be greater than the diameters of the left-hand bearing journals 4, but this is not absolutely essential.

There must be sufficient clearance between the bearing journals 4, 5 and the guides 20, 21 in order not to jam the rolls in the guides. Since the projections 25 in the recesses 12 can be freely moved in the direction of the roll axis, the bearing journals 5 are provided with axial guide surfaces 10, which cooperate with corresponding second guide surfaces 24 on the guides 21, in order to prevent the bearing journals 5 from slipping out at least from the guides 21. The axial guide surfaces 10 are formed on the bearing journals 5, in particular as shown in the figures, by the side-wall of the circumferential groove 7 nearer the end 11, in which bars 27 facing each other on the guides 21 engage, to which the second guide surfaces 24 are attached. Axial guide surfaces 10 can however also be provided on tooth-like projections or similar protruding from the periphery of the bearing journals 5, which makes a circumferential groove unnecessary. The axial guide surfaces 10 and the second guide surfaces 24 lie in particular in radial planes of the roll axis, but can also, as shown in FIG. 5, be conical surfaces.

Figure 2:
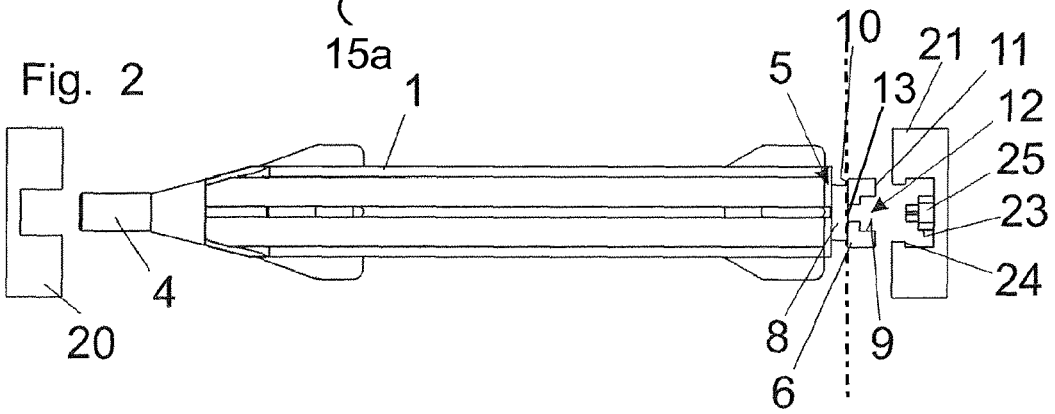
Figure 3:
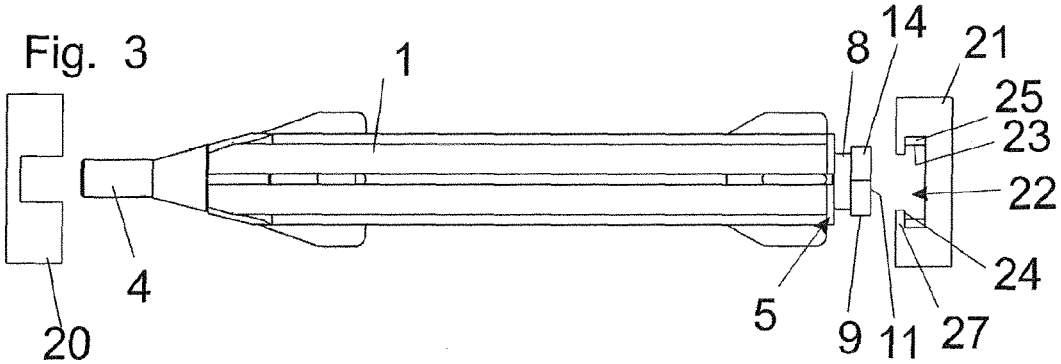
Figure 4:
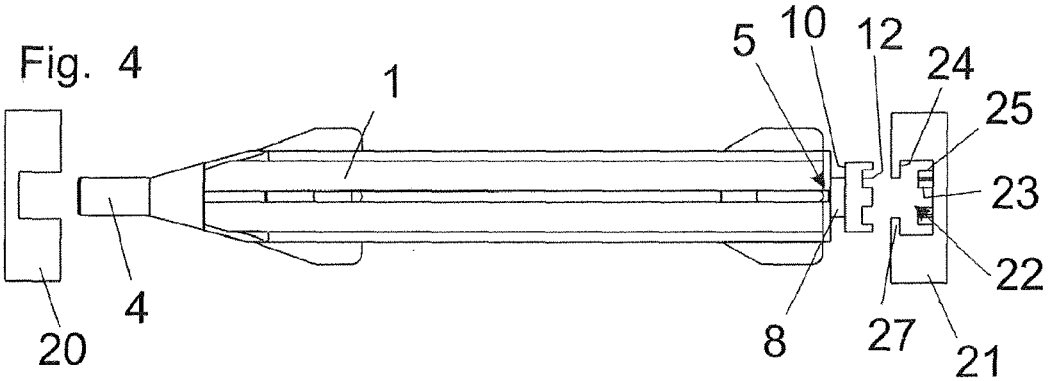

Particularly advantageous embodiments are shown by FIG. 2 and FIG. 7 on the right. In FIG. 2, the depth of the recess 12 is equal to the length of the end-section 6, so that the bottom 13 of the recess 12 is flush with the side wall of the circumferential groove 7 nearer the free end 11 of the bearing journal 5. In FIG. 7 on the right the recess 12 also extends into the circumferential groove 7. Both embodiments provide particularly good assurance that only bearing journals 5 in the embodiments shown in FIG. 2 or FIG. 7 on the right can be inserted into the guides 21 shown in FIG. 2 or FIG. 7 on the right, since in both embodiments it would not be possible to shorten the end-section 6 of a bearing journal 5 in order to circumvent the projection 25 in the guide 21. In this case the axial guide surface 10 would actually be omitted.

The invention claimed is:

1. A roll assembly for supporting a material web in a dispenser, comprising:

a roll for supporting the material web, said roll having an axis and two ends for rotatably supporting the roll assembly in the dispenser;

bearing journals projecting from the two ends of the roll, at least one of said bearing journals having:

a circumferential groove and a free end insertable into a guide of the dispenser, said groove having side surfaces, a first of said surfaces being nearer said free end of said bearing journal;

a bearing surface defining the bottom of said circumferential groove and defined by a surface of revolution around said axis;

at least one centrally positioned recess formed in said free end of said bearing journal and open towards said free end;

a fitting surface defined by a surface other than the surface of revolution around said axis, said fitting surface being formed in said at least one recess; and a guide surface formed in said circumferential groove by said first side surface nearer the free end of said bearing journal.

2. The roll assembly according to claim 1, wherein said bearing journal is formed to project from an end cap configured to be inserted into a core sleeve of the material web.

3. The roll assembly according to claim 1, wherein said bearing journal forms an end part of a support rod defining said roll and projecting through the material web.

* * * * *